US006868826B1

(12) United States Patent
Oono

(10) Patent No.: US 6,868,826 B1
(45) Date of Patent: Mar. 22, 2005

(54) FUEL PRESSURE CONTROL APPARATUS OF AN INTERNAL COMBUSTION ENGINE

(75) Inventor: Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/895,895

(22) Filed: Jul. 22, 2004

(30) Foreign Application Priority Data

Feb. 20, 2004 (JP) ..... 2004-044844

(51) Int. Cl.[7] ..... F20D 9/08
(52) U.S. Cl. ..... 123/339.1; 123/445
(58) Field of Search ..... 123/319, 332, 123/333, 339.1, 339.14, 445, 446, 457, 472

(56) References Cited

U.S. PATENT DOCUMENTS 3,961,612 A * 6/1976 Okamoto et al. ..... 123/462

FOREIGN PATENT DOCUMENTS

JP 61-096162 A 5/1986
JP 11-324757 A 11/1999

* cited by examiner

*Primary Examiner*—Bibhu Mohanty
(74) *Attorney, Agent, or Firm*—Sughrue Mion, PLLC

(57) ABSTRACT

A fuel pressure control apparatus is provided with a fuel pump for supplying the high-pressure fuel to an accumulator, a fuel pressure sensor for detecting a fuel pressure in the accumulator, an idling switch for detecting, on the basis of an accelerator manipulation, whether the internal combustion engine is in an idling state, an ECU for controlling an amount of fuel that is supplied from the fuel pump to the accumulator so that the fuel pressure in the accumulator that is detected by the fuel pressure sensor coincides with a target fuel pressure that is set in accordance with a rotation speed and a load of the internal combustion engine, and a target fuel pressure switching unit for restricting the target fuel pressure to a prescribed fuel pressure or lower while the idling switch detects that the internal combustion engine is in an idling state.

8 Claims, 10 Drawing Sheets

FUEL PRESSURE CONTROL APPARATUS OF AN INTERNAL COMBUSTION ENGINE

BACKGROUND OF THE INVENTION

1. Field of the Invention

The present invention relates to a fuel pressure control apparatus for controlling the fuel pressure in an accumulator to a target pressure suitable for a vehicle situation in an internal combustion engine in which fuel that is accumulated in the accumulator is injected into a combustion chamber from a fuel injection valve.

2. Description of the Related Art

In what is called a direct injection internal combustion engine in which high-pressure fuel is directly injected into its combustion chamber, the injection characteristics such as the jet shape, momentum, particle size, and injection rate of fuel jetted from a fuel injection valve vary with the fuel pressure. To improve the combustion characteristics, fuel efficiency and, exhaust gas performance of the internal combustion engine, it is required to variably control the fuel pressure to a pressure that is most suitable for an operation statuses of the internal combustion engine. To satisfy this requirement, various fuel pressure control apparatus have been proposed in which the fuel pressure in an accumulator is controlled to a target pressure by controlling the amount of fuel that is supplied from a high-pressure fuel pump to the accumulator with an electromagnetic control valve for each cycle of the high-pressure fuel pump.

For example, JP-A-11-324757 (pages 4–6, FIGS. 1–7) discloses the following technique. In a direct injection type fuel injection device, the fuel supply amount of each time is controlled by feedback-controlling a pressure regulator that is provided on a fuel supply path on the basis of a target fuel pressure that is set in accordance with operation conditions of an internal combustion engine and a detection value of the fuel pressure in an accumulator and feedforward-controlling the pressure regulator so that an amount of fuel corresponding to that supplied from a fuel injection valve to an internal combustion engine is supplied from a fuel pump to the accumulator. As a result, the fuel pressure in the accumulator is caused to follow the target fuel pressure with high responsivity.

JP-A-61-96162 (pages 2–4, FIGS. 1–7) discloses the following technique which is directed to a fuel injection device for a diesel engine. A relief valve whose degree of opening varies linearly with the current is provided in a high-pressure fuel passage from a high-pressure fuel pump to a fuel injection valve. The fuel pressure in the high-pressure fuel passage is controlled by supplying a current to the coil of the relief valve in accordance with a detection value of the fuel pressure in the high-pressure fuel passage and engine operation statuses. As a result, during idling or a light-load operation, the fuel injection rate is lowered to reduce the noise and vibration. During a heavy-load operation, the injection rate is increased by setting the relief pressure higher than a pressure generated by the high-pressure fuel pump.

In the conventional fuel pressure control apparatus of JP-A-11-324757, although a control for increasing the fuel pressure in the accumulator can be performed easily, a control for lowering the fuel pressure cannot be performed actively because of the configuration of the apparatus. That is, although the fuel pressure in the accumulator can be increased by supplying fuel the amount of which exceeds an injection amount of the fuel injection valve, even if the amount of fuel discharged from the fuel pump is lowered or the fuel discharge is stopped the fuel pressure in the accumulator does not decrease until fuel that is injected from the fuel injection valve to the combustion chamber of the internal combustion engine is consumed. A state that the pressure in the accumulator does not coincide with a target fuel pressure continues for a time that is taken to consume the fuel.

In the control of JP-A-11-324757, a target fuel pressure is determined according to a two-dimensional map having the rotation speed and the load of the internal combustion engine as parameters and the target fuel pressure is set higher as the rotation speed or the load of the internal combustion engine increases. When the internal combustion engine is started in a state that such a target fuel pressure map is set, the rotation speed and the load vary in the following manner. When the ignition switch is turned on, the internal combustion engine is driven by the starter motor and the rotation speed is increased to a start rotation speed. The load of the internal combustion engine increases rapidly during a period from the turning-on of the ignition switch to complete combustion (i.e., a start period). Start fuel suitable for the load is supplied from the fuel injection valve. And fuel suitable for the load is supplied from the fuel pump to the accumulator, whereby the fuel pressure in the accumulator increases to a target fuel pressure.

Once complete combustion occurs in the internal combustion engine, the rotation speed converges to an idling rotation speed after a temporal increase and the load decreases accordingly. As a result, the target fuel pressure decreases rapidly according to the target fuel pressure map. However, since as described above the decrease in accumulator pressure depends on the fuel consumption by the discharge from the fuel injection valve, the accumulator pressure becomes higher than the target fuel pressure. That is, a state that the actual fuel pressure does not coincide with the target fuel pressure though the operation state of the internal combustion engine has converged to the idling state continues for a prescribed time. Because an operation state at a fuel pressure that does not provide optimum combustion performance continues for the prescribed time, deteriorated combustion performance may cause misfires etc.

In the control of JP-A-61-96162, a target fuel pressure is determined according to a two-dimensional map having the rotation speed and the throttle position of the internal combustion engine as parameters. Therefore, for example, the target fuel pressure is set higher as the rotation speed or the degree of opening of the throttle valve of the internal combustion engine increases. If with such settings the internal combustion engine is gunned in an idling state, the rotation speed of the internal combustion engine is increased in accordance with the accelerator manipulation and the target fuel pressure is switched according to the target fuel pressure map. As a result, a large amount of fuel is supplied from the high-pressure pump to the accumulator and the fuel pressure in the accumulator increases toward the new target fuel pressure.

However, when a gunning manipulation is performed, the throttle valve is opened and then closed immediately. The rotation speed of the internal combustion engine starts to decrease toward an original idling rotation speed. As a result, the target fuel pressure decreases to a value corresponding to the original idling rotation speed and the actual fuel pressure in the accumulator becomes higher than the target fuel pressure. Therefore, a state that the actual fuel pressure does not coincide with the target fuel pressure though the operation state of the internal combustion engine has already converged to the idling state continues for a prescribed time. Because an operation state at a fuel pressure that does not provide optimum combustion performance continues for the prescribed time, deteriorated combustion performance may cause misfires etc.

SUMMARY OF THE INVENTION

The present invention has been made to solve the above problems, and an object of the invention is therefore to provide a fuel pressure control apparatus of an internal combustion engine capable of reducing the probability of occurrence of misfires etc. due to deteriorated combustion performance by shortening the duration of an operation at a fuel pressure that does not provide optimum combustion performance by shortening a period when the actual fuel pressure does not coincide with the target fuel pressure after, for example, a start of the internal combustion engine or a gunning manipulation (convergence is made to an idling state).

A fuel pressure control apparatus of an internal combustion engine according to the invention comprises a fuel injection valve for injecting fuel into a combustion chamber of the internal combustion engine; an accumulator for accumulating high-pressure fuel and for supplying fuel to the fuel injection valve; a fuel pump for supplying the high-pressure fuel to the accumulator; a fuel pressure sensor for detecting a fuel pressure in the accumulator; idling detecting means for detecting, on the basis of an accelerator manipulation, whether the internal combustion engine is in an idling state; control means for controlling an amount of fuel that is supplied from the fuel pump to the accumulator so that the fuel pressure in the accumulator that is detected by the fuel pressure sensor coincides with a target fuel pressure that is set in accordance with a rotation speed and a load of the internal combustion engine; and target fuel pressure switching means for restricting the target fuel pressure to a prescribed fuel pressure or lower while the idling detecting means detects that the internal combustion engine is in an idling state.

In the above-configured fuel control apparatus of an internal combustion engine according to the invention, in, for example, a period from a start of the internal combustion engine to a time of convergence to an idling rotation speed, the target fuel pressure is set with the aid of the idling detecting means independently of the rotation speed or the load. Therefore, a transitional behavior of the fuel pressure as occurs in the conventional apparatus immediately after a start of the internal combustion engine can be prevented, whereby the duration of an operation at a fuel pressure that does not provide optimum combustion performance can be shortened by shortening a period when the actual fuel pressure does not coincide with the target fuel pressure. The probability of occurrence of misfires etc. due to deteriorated combustion performance can thus be reduced greatly. Further, since switching is made to a target fuel pressure corresponding to a target idling rotation speed and a load of the internal combustion engine, an idling rotation speed reflecting, for example, variations in electric loads of a generator and a fuel pressure suitable for such an idling rotation speed can be obtained. This makes it possible to suppress misfires etc. due to deteriorated combustion performance and to reduce, for example, deterioration of the exhaust gas performance.

DESCRIPTION OF THE PREFERRED EMBODIMENTS

Embodiment 1

Figure 1:
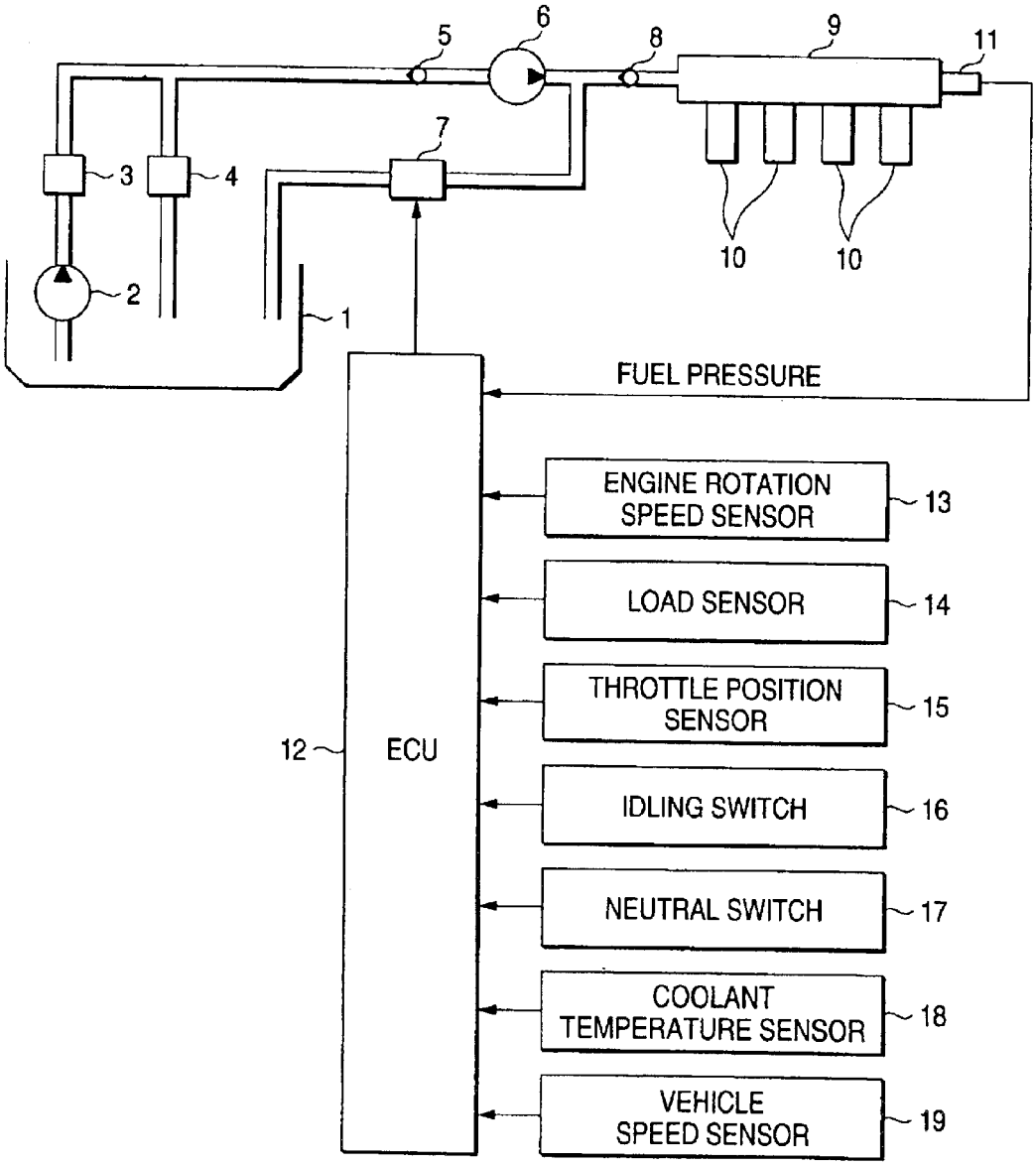
FIG. 1 is a block diagram showing the configuration of a fuel pressure control apparatus of an internal combustion engine according to a first embodiment of the present invention.
Figure 2:
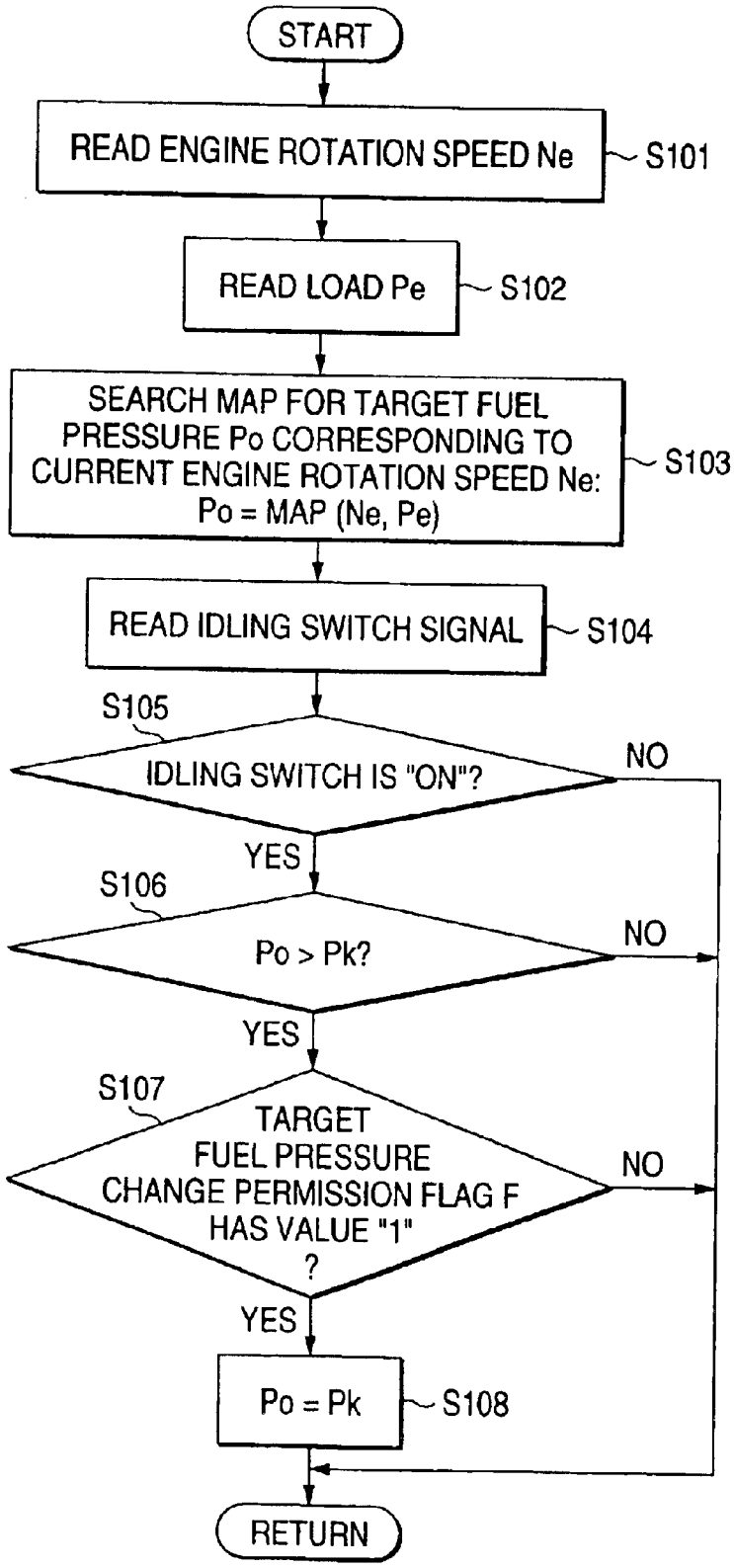
FIGS. 2 and 3 area flowchart and a time chart, respectively, showing the operation of the fuel pressure control apparatus of an internal combustion engine according to the first embodiment of the invention.
Figure 3:
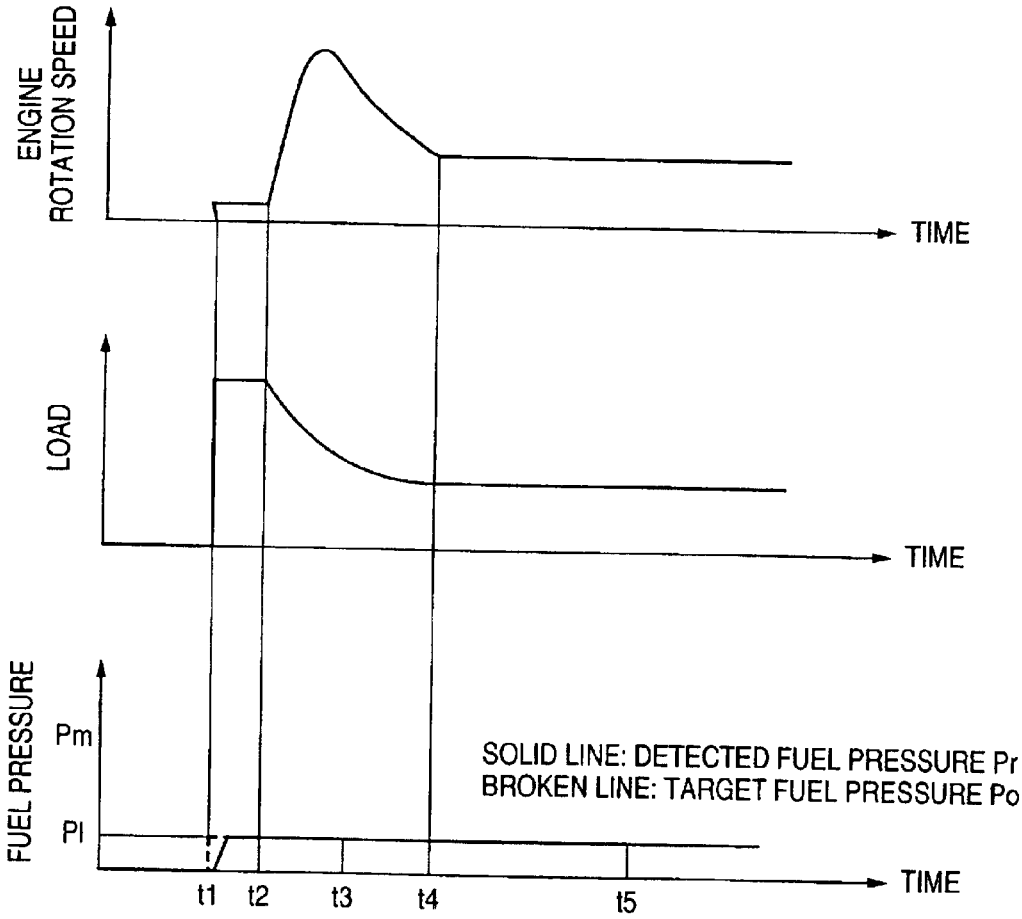

FIGS. 1–3 illustrate a fuel pressure control apparatus of an internal combustion engine according to a first embodiment of the present invention. More specifically, FIG. 1 is a block diagram showing the configuration of the fuel pressure control apparatus, FIG. 2 is a flowchart of a control operation of an ECU, and FIG. 3 is a time chart of an operation that is performed at a start of an internal combustion engine. As shown in FIG. 1, a feed pump 2 for compression-transporting fuel from a fuel tank 1 is attached to the fuel tank 1. Fuel that is discharged from the feed pump 2 goes through a fuel filter 3, is subjected to adjustment to a constant pressure by a low-pressure pressure regulator 4, and is supplied to the high-pressure fuel pump 6 via a check valve 5. The high-pressure fuel pump 6, which is an ordinary plunger-type pump, has a cam shaft that is driven by the internal combustion engine and a plunger that is moved upward and downward by a cam of the cam shaft. And the high-pressure fuel pump 6 is configured so as to suck in fuel when the plunger goes down and to discharge fuel through an outlet when the plunger goes up.

An electromagnetic control valve 7 as a fuel pressure control means is disposed between the outlet of the high-pressure fuel pump 6 and the fuel tank 1. The outlet of the high-pressure fuel pump 6 is connected to an accumulator (common rail) 9 via a check valve 8. Fuel injection valves 10 that are the same in number as the cylinders of the internal combustion engine and are attached to the combustion chambers (not shown) of the internal combustion engine are connected to the accumulator 9. High-pressure fuel is supplied from the accumulator 9 to the fuel injection valves 10 and fuel is directly injected into the combustion chambers from the respective fuel injection valves 10. A fuel pressure sensor 11 for detecting a fuel pressure in the accumulator 9 is attached to the accumulator 9.

Receiving a fuel pressure signal from the fuel pressure sensor 11, an ECU (electronic control unit) as a control means controls the amount of fuel supplied from the high-pressure fuel pump 6 to the accumulator 9 by controlling the electromagnetic control valve 7 so that the fuel pressure in the accumulator 9 becomes equal to a target pressure that is set in accordance with operation statuses of the internal combustion engine. Further, to supply fuel to the combustion chambers while setting the fuel pressure to a target fuel pressure that is suitable for operation statuses, the ECU 12 also receives, as internal combustion engine operation information, various signals from an internal combustion engine rotation speed sensor 13, an internal combustion engine load sensor 14, a throttle position sensor 15, an idling switch 16, a neutral switch 17, a temperature sensor 18, a vehicle speed sensor 19, etc. The idling switch 16 generates an on signal when the throttle position is at the entirely closed position. The neutral switch 17 generates an on signal when the transmission is at the neutral position. The temperature sensor 18 detects a temperature of the coolant of the internal combustion engine. The ECU 12 is equipped with a target idling rotation speed setting means for setting a target idling rotation speed when the throttle valve is in the entirely closed state and a target fuel pressure switching means (described later).

The operation of the ECU 12 of the above-configured fuel pressure control apparatus of an internal combustion engine according to the first embodiment of the invention will be described below with reference to the flowchart of FIG. 2. The control operation routine is executed repeatedly in a prescribed cycle. In the following description, it is assumed that a target fuel pressure change permission flag F to be used for judging, at step S107, whether to permit operation of the target fuel pressure switching means has a value "1." First, at step S101, a rotation speed Ne of the internal combustion engine is read from the rotation speed sensor 13. At step S102, a load Pe of the internal combustion engine is read from the load sensor 14. At step S103, a map is searched for a target fuel pressure Po =MAP(Ne, Pe) on the basis of parameters that are the rotation speed Ne that was read at step S101 and the load Pe that was read at step S102.

At step S104, a signal from the idling switch 16 is read. At step S105, it is judged whether the idling switch signal is "on." If the idling switch 16 is not "on," the execution of this routine is finished and a return is made to the start. If the idling switch 16 is "on," the routine goes to the next step S106. At step S106, it is judged whether the target fuel pressure Po that was determined by the map search at step S103 is higher than a prescribed fuel pressure Pk (e.g., a target fuel pressure for the idling state of the internal combustion engine). If the target fuel pressure Po is not higher than the prescribed fuel pressure Pk, the execution of this routine is finished and a return is made to the start. If the target fuel pressure Po is higher than the prescribed fuel pressure Pk, the routine goes to step S107.

At step S107, it is judged whether the target fuel pressure change permission flag F to be used for judging whether to permit operation of the target fuel pressure switching means has a value "1"(i.e., the flag F is set). Since the flag F has a value "1" as mentioned above, the routine goes to step S108. At step S108, the target fuel pressure Po that was determined by the map search at step S103 is replaced by the prescribed fuel pressure Pk. Then, the execution of the routine is finished and a return is made to the start. From this time onward, the electromagnetic valve 7 is controlled so that the fuel pressure in the accumulator 9 becomes equal to the target fuel pressure Po that was replaced by Pk at step S108. While it is judged that the internal combustion engine is in an idling state (i.e., the idling switch 16 is "on"), the upper limit of the fuel pressure in the accumulator 9 is restricted to the prescribed fuel pressure Pk.

At step S107, whether the target fuel pressure change permission flag F is set to "1" is judged if it is detected that the idling switch 16 is "on" and the target fuel pressure Po is higher than the target fuel pressure Pk for the idling state of the internal combustion engine. If the flag F is set to "1," operation of the target fuel pressure switching means is permitted. When this routine is executed at an initial stage after a start of the internal combustion engine, the fuel pressure is set to the target fuel pressure Pk for the idling state of the internal combustion engine if it is detected that the idling switch 16 is "on" irrespective of the load state. An operation after a start will be described with reference to FIG. 3. The internal combustion engine is started at time t1. Until time t2 when the internal combustion engines reaches a complete combustion state (i.e., in a start period), the load increases rapidly. However, as long as the idling switch 16 is "on," the fuel pressure is kept lower than or equal to the target fuel pressure Pk for the idling state. After time t2, the rotation speed increases because of the complete combustion of the internal combustion engine. Until time t4 when the rotation speed reaches an idling rotation speed, the fuel pressure is kept lower than or equal to the target fuel pressure Pk for the idling state independently of the rotation speed and the load.

Therefore, a transitional behavior of the fuel pressure as occurs in the conventional apparatus in and after a start period of the internal combustion engine can be prevented and the duration of an operation at a fuel pressure that does not provide optimum combustion performance can be shortened by shortening a period when the detected fuel pressure Pr does not coincide with the target fuel pressure Po from a start of the internal combustion engine to a time of convergence to an idling state that follows a start period. The probability of occurrence of misfires etc. due to deteriorated combustion performance can thus be reduced.

Embodiment 2

Figure 4:
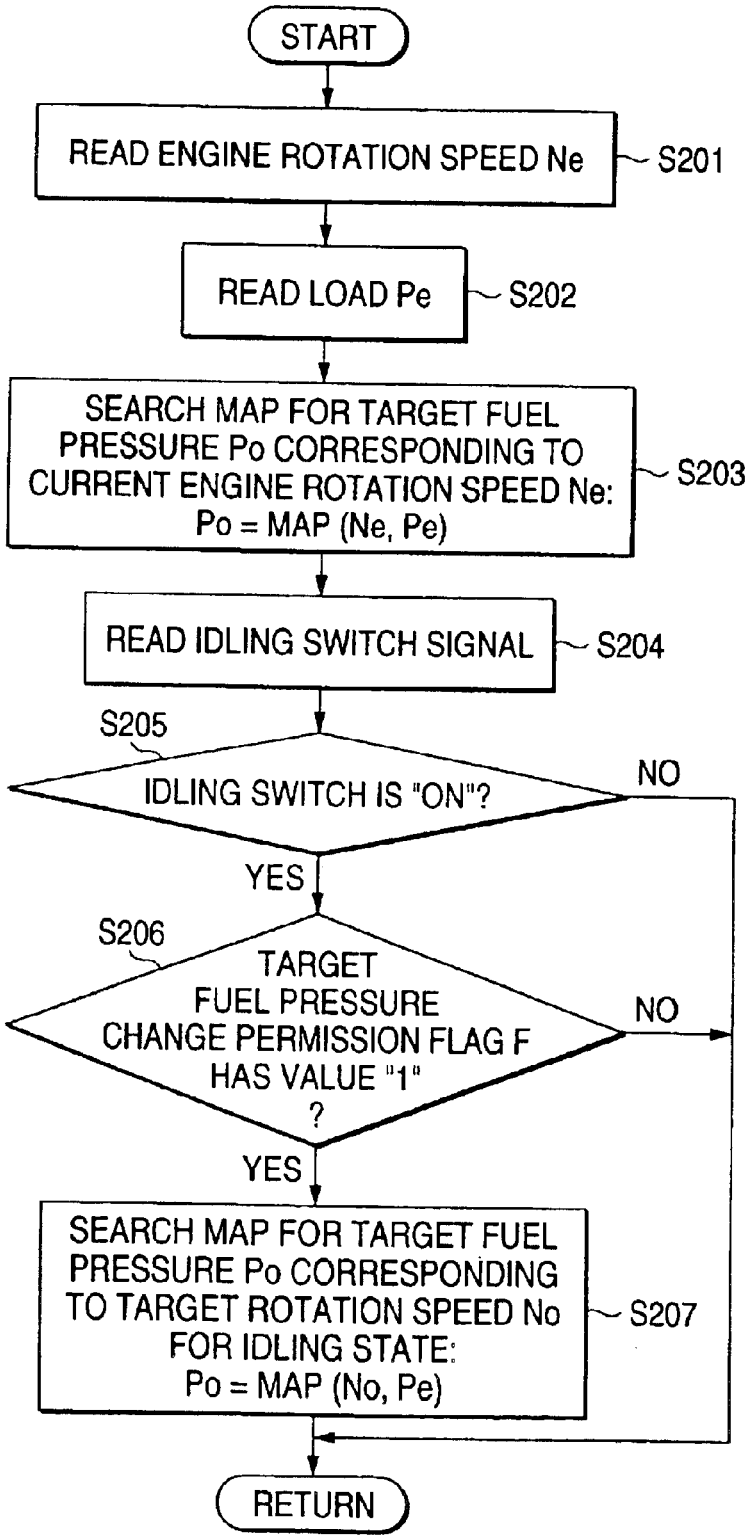
FIG. 4 is a flowchart showing the operation of a fuel pressure control apparatus of an internal combustion engine according to a second embodiment of the invention.

FIG. 4 is a flowchart of a control operation of an ECU of a fuel pressure control apparatus of an internal combustion engine according to a second embodiment of the invention. This control routine is repeated in a prescribed cycle. The fuel pressure control apparatus of an internal combustion engine according to this embodiment has the same configuration as that according to the first embodiment shown in FIG. 1. The operation of the ECU 12 according to this embodiment will be described below with reference to FIG. 4. As in the case of the first embodiment, it is assumed that a target fuel pressure change permission flag F to be used for judging, at step S206, whether to permit operation of the target fuel pressure switching means has a value "1."

First, at step S201, a rotation speed Ne of the internal combustion engine is read from the rotation speed sensor 13. At step S202, a load Pe of the internal combustion engine is read from the load sensor 14. At step S203, a map is searched for a target fuel pressure Po=MAP(Ne, Pe) on the basis of parameters that are the rotation speed Ne that was read at step S201 and the load Pe that was read at step S202. At step S204, a signal from the idling switch 16 is read. At step S205, it is judged whether the idling switch signal is "on" or "off."If the idling switch 16 is not "on," the execution of this routine is finished and a return is made to the start. If the idling switch 16 is "on," the routine goes to the next step S206.

At step S206, it is judged whether the target fuel pressure change permission flag F to be used for judging whether to permit operation of the target fuel pressure switching means has a value "1"(i.e., the flag F is set). Since the flag F has a value "1" as mentioned above, the routine goes to step S207. At step S207, a map is searched again for a target fuel pressure Po MAP(No, Pe) on the basis of parameters that are the load Pe that was read at step S202 and a target internal combustion engine rotation speed No for the idling state that was determined in advance by a target idling rotation speed setting means (not shown) in accordance with, for example, a temperature detected by the temperature sensor 18. Then, the execution of the routine is finished. From this time onward, the electromagnetic valve 7 is controlled so that the fuel pressure in the accumulator 9 becomes equal to the target fuel pressure Po that was replaced at step S207. While it is judged that the internal combustion engine is in an idling state (i.e., the idling switch 16 is "on"), the fuel pressure in the accumulator 9 is controlled so as to become equal to the target fuel pressure Po corresponding to the target idling rotation speed No for the idling state instead of the internal combustion engine rotation speed Ne that was read at step S201.

At step S206, whether the target fuel pressure change permission flag F is set to "1" is judged if it is detected that the idling switch 16 is "on." If the flag F is set to "1" operation of the target fuel pressure switching means is permitted. In this embodiment, a target fuel pressure Po corresponding to the target idling rotation speed No for the idling state and a load Pe is set instead of replacing the target fuel pressure Po with the prescribed fuel pressure Pk (first embodiment). Even with this operation, as in the case of the first embodiment, a transitional behavior of the fuel pressure as occurs in the conventional apparatus in and after a start period of the internal combustion engine can be prevented and a period when the detected fuel pressure Pr does not coincide with the target fuel pressure Po from a start of the internal combustion engine to a time of convergence to an idling state that follows a start period can be shortened. The probability of occurrence of misfires etc. due to deteriorated combustion performance can thus be reduced.

Embodiment 3

Figure 5:
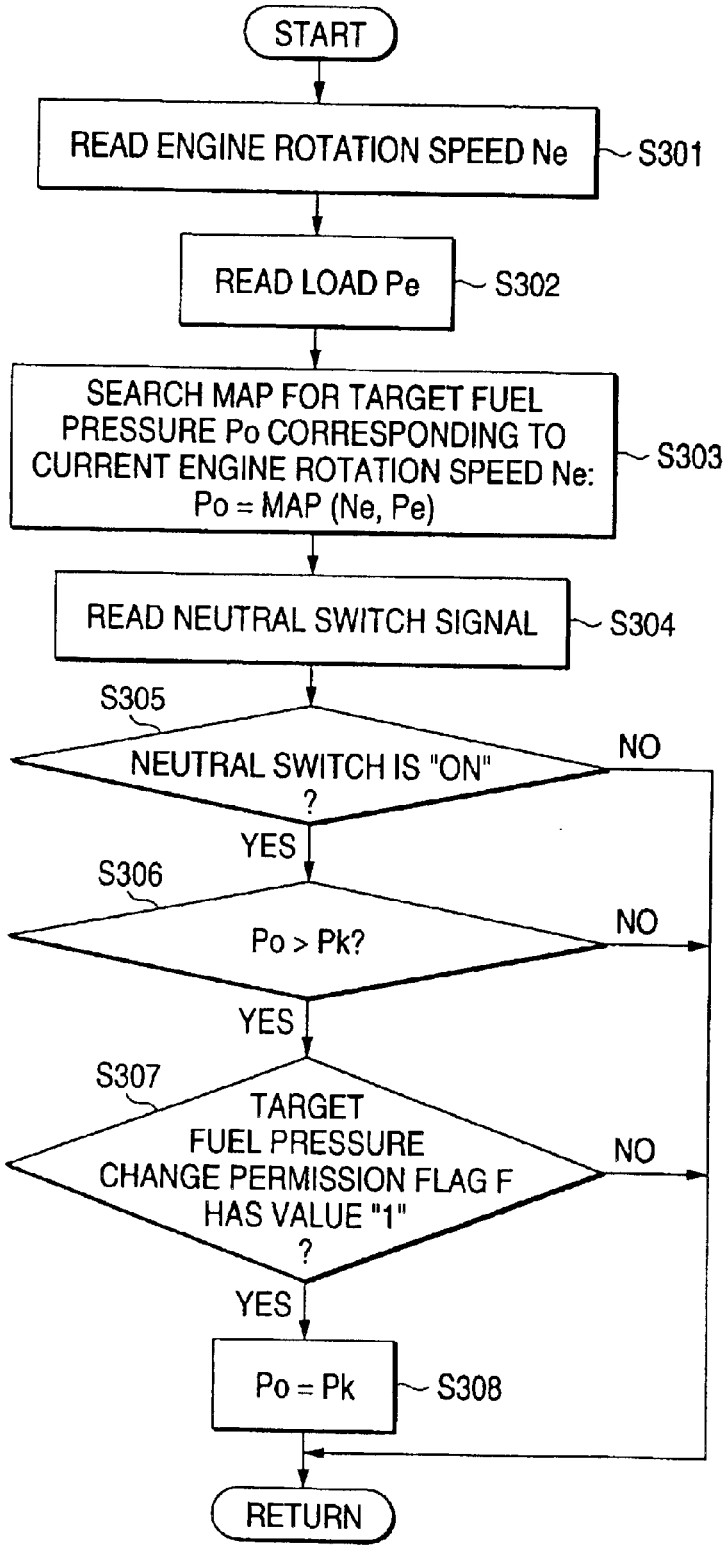
FIGS. 5 and 6 are a flowchart and a time chart, respectively, showing the operation of a fuel pressure control apparatus of an internal combustion engine according to a third embodiment of the invention.
Figure 6:
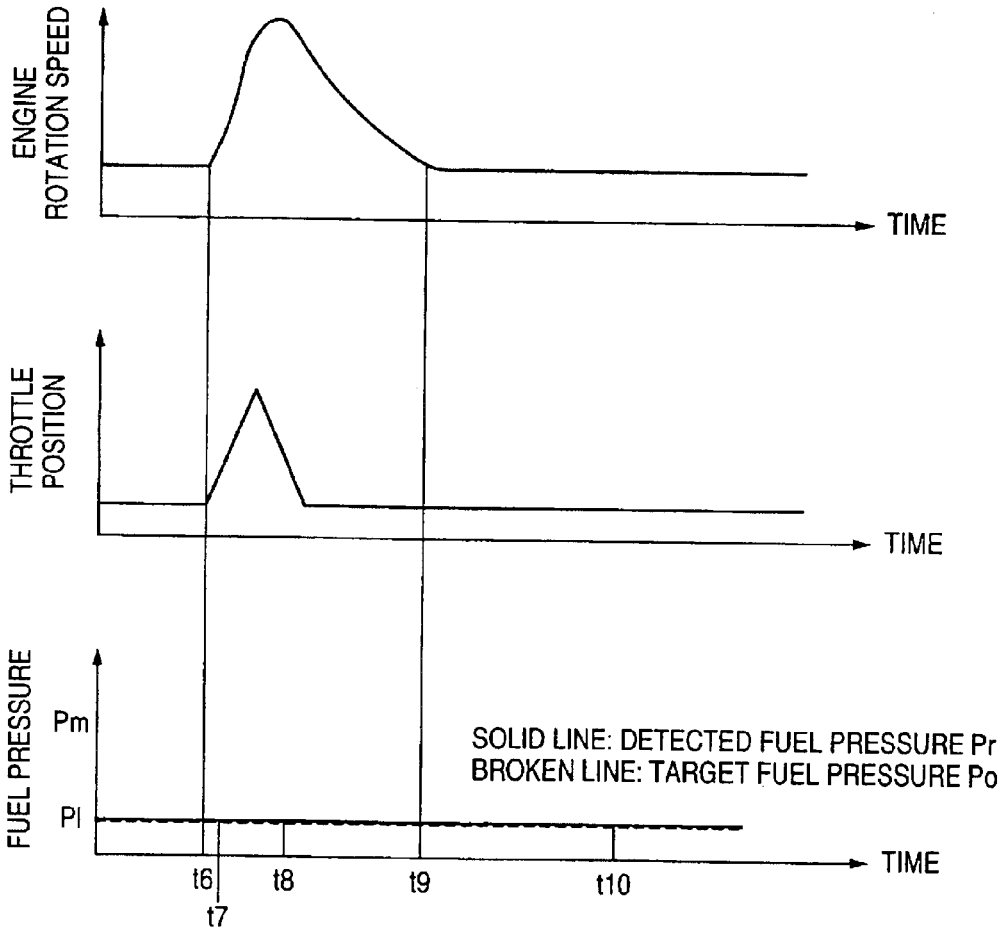

FIG. 5 is a flowchart of a control operation of an ECU of a fuel pressure control apparatus of an internal combustion engine according to a third embodiment of the invention. FIG. 6 is a time chart of an operation that is performed at a start of an internal combustion engine. The control routine of FIG. 5 is repeated in a prescribed cycle. The fuel pressure control apparatus of an internal combustion engine according to this embodiment has the same configuration as that according to the first embodiment shown in FIG. 1. The operation of the ECU 12 according to this embodiment will be described below with reference to FIG. 5. It is assumed that a target fuel pressure change permission flag F to be used for judging, at step S307, whether to permit operation of the target fuel pressure switching means has a value "1."

First, at step S301, a rotation speed Ne of the internal combustion engine is read from the rotation speed sensor 13. At step S302, a load Pe of the internal combustion engine is read from the load sensor 14. At step S303, a map is searched for a target fuel pressure Po=MAP(Ne, Pe) on the basis of parameters that are the rotation speed Ne that was read at step S301 and the load Pe that was read at step S302. At step S304, a neutral switch signal is read from the neutral switch 17. At step S305, it is judged whether the neutral switch signal that was read at step S304 is "on." If the neutral switch 17 is not "on," the execution of this routine is finished and a return is made to the start. If the neutral switch 17 is "on," the routine goes to the next step S306.

At step S306, it is judged whether the target fuel pressure Po that was determined by the map search at step S303 is higher than a prescribed fuel pressure Pk (e.g., a target fuel pressure for the idling state of the internal combustion engine). If the target fuel pressure Po is not higher than the prescribed fuel pressure Pk, the execution of this routine is finished and a return is made to the start. If the target fuel pressure Po is higher than the prescribed fuel pressure Pk, the routine goes to step S307. At step S307, whether the target fuel pressure change permission flag F has a value "1" is judged to judge whether to permit operation of the target fuel pressure switching means. Since the flag F has a value "1" as mentioned above, the routine goes to step S308.

At step S308, the target fuel pressure Po that was determined by the map search at step S303 is replaced by the prescribed fuel pressure Pk. Then, the execution of the routine is finished. From this time onward, the electromagnetic valve 7 is controlled so that the fuel pressure in the accumulator 9 becomes equal to the target fuel pressure Po that was replaced by Pk at step S308. That is, while it is judged that the transmission is at the neutral position (i.e., the neutral switch 17 is "on"), the upper limit of the fuel pressure in the accumulator 9 is restricted to the prescribed fuel pressure Pk.

FIG. 6 shows an operation of the fuel pressure control apparatus of an internal combustion engine according to the third embodiment of the invention that performs the above control. While it is judged that the transmission is at the neutral position, the target fuel pressure Po is controlled according to the flowchart of FIG. 5 so as to become equal to the prescribed fuel pressure Pk. Even when the engine is gunned at time t6 in FIG. 6 by an accelerator manipulation, the fuel pressure is restricted to Pk or lower. The duration of an operation at a fuel pressure that does not provide optimum combustion performance can be shortened because a period when the actual fuel pressure does not coincide with the target fuel pressure from gunning to a time of convergence to an idling state is shortened. The probability of occurrence of misfires etc. due to deteriorated combustion performance can thus be reduced.

Embodiment 4

Figure 7:
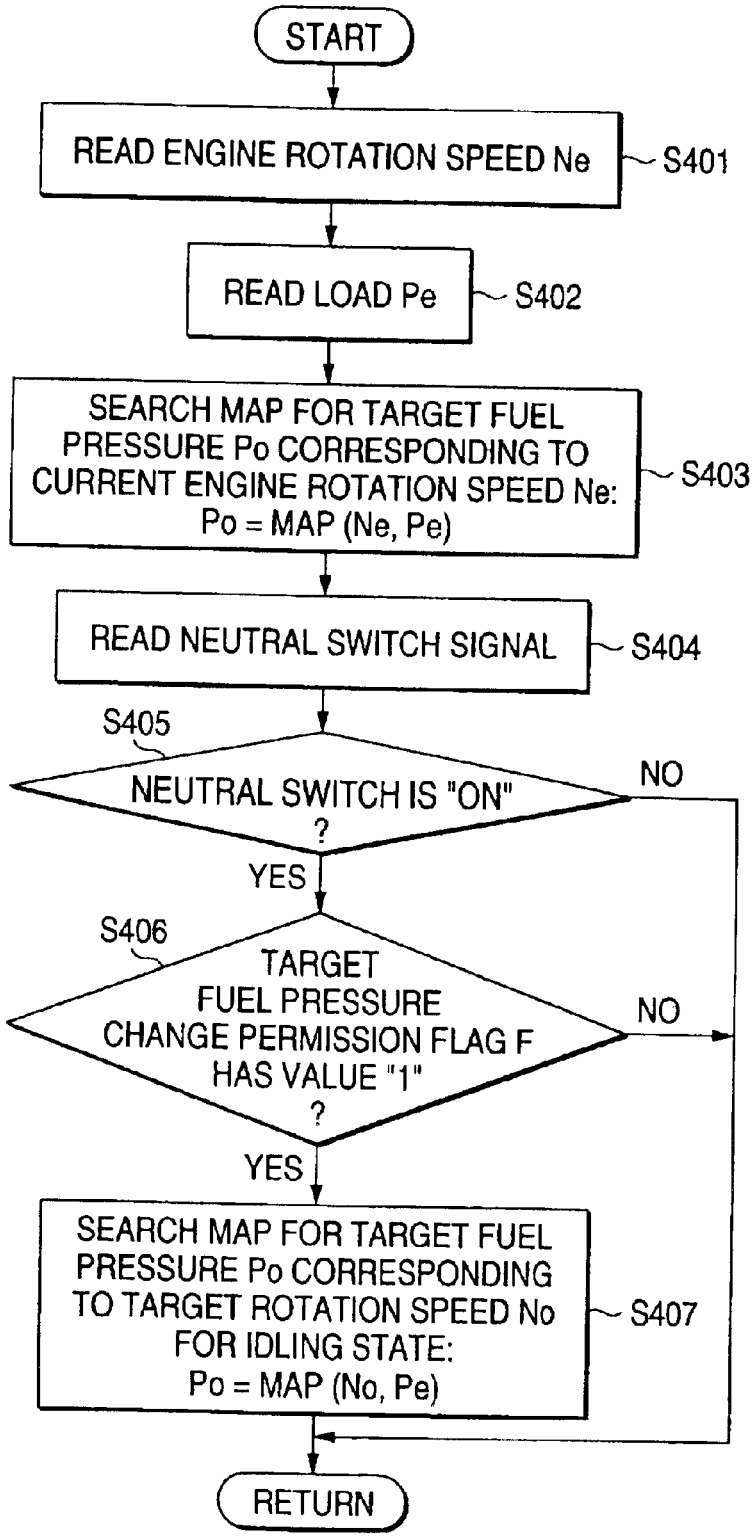
FIG. 7 is a flowchart showing the operation of a fuel pressure control apparatus of an internal combustion engine according to a fourth embodiment of the invention.

FIG. 7 is a flowchart of a control operation of an ECU of a fuel pressure control apparatus of an internal combustion engine according to a fourth embodiment of the invention. This control routine is repeated in a prescribed cycle. The fuel pressure control apparatus of an internal combustion engine according to this embodiment has the same configuration as that according to the first embodiment shown in FIG. 1. The operation of the ECU 12 according to this embodiment will be described below with reference to FIG. 7. As in the case of the third embodiment, it is assumed that a target fuel pressure change permission flag F to be used for judging, at step S406, whether to permit operation of the target fuel pressure switching means has a value "1."

Also in this embodiment, first, at step S401, a rotation speed Ne of the internal combustion engine is read from the rotation speed sensor 13. At step S402, a load Pe of the internal combustion engine is read from the load sensor 14. At step S403, a map is searched for a target fuel pressure Po=MAP(Ne, Pe) on the basis of parameters that are the rotation speed Ne that was read at step S401 and the load Pe that was read at step S402. At step S404, a neutral switch signal is read from the neutral switch 17. At step S405, it is judged whether the neutral switch signal that was read at step S404 is "on." If the neutral switch 17 is notion "on," the execution of this routine is finished and a return is made to the start. If the neutral switch 17 is "on," the routine goes to the next step S406.

At step S406, it is judged whether the target fuel pressure change permission flag F to be used for judging whether to permit operation of the target fuel pressure switching means has a value "1." Since the flag F has a value "1" as mentioned above, the routine goes to step S407. At step S407, a map is searched again for a target fuel pressure Po=MAP(No, Pe) on the basis of parameters that are a target rotation speed No for the idling state that was determined in advance in accordance with, for example, a coolant temperature detected by the temperature sensor 18 and energization states of various electric loads and the load Pe that was read at step S402. Then, the execution of the routine is finished.

From this time onward, the electromagnetic valve 7 is controlled so that the fuel pressure in the accumulator 9 becomes equal to the target fuel pressure Po that was replaced at step S407. While it is judged that the internal combustion engine is in a neural state (i.e., the neutral switch 17 is "on"), the fuel pressure in the accumulator 9 is controlled so as to become equal to the target fuel pressure Po corresponding to the target idling rotation speed No for the idling state instead of the internal combustion engine rotation speed Ne that was read at step S401. This embodiment provides the same advantages as the third embodiment does except that the fuel pressure is controlled in accordance with the coolant temperature and the loads of the internal combustion engine including the electric loads.

Embodiment 5

Figure 8:
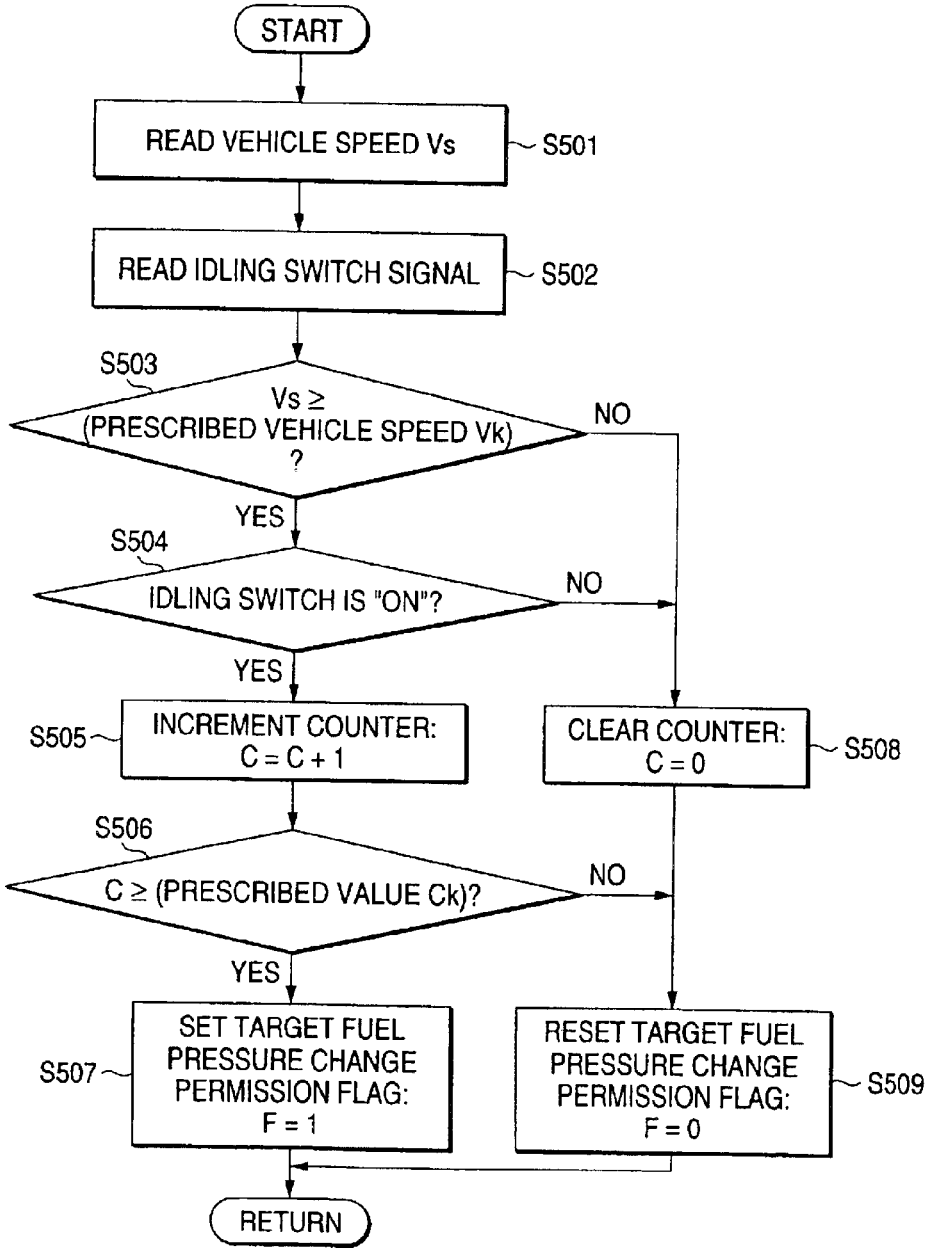
FIG. 8 is a flowchart showing the operation of a fuel pressure control apparatus of an internal combustion engine according to a fifth embodiment of the invention.

FIG. 8 is a flowchart of a control operation of an ECU of a fuel pressure control apparatus of an internal combustion engine according to a fifth embodiment of the invention. This control routine is repeated in a prescribed cycle.

In this embodiment, first, at step S501, a vehicle speed Vs is read from the vehicle speed sensor 19. At step S502, an idling switch signal is read from the idling switch 16. At step S503, it is judged whether the vehicle speed Vs that was read at step S501 is higher than or equal to a prescribed vehicle speed Vk. If the vehicle speed Vs is lower than the prescribed vehicle speed Vk, the routine goes to step S508, where the count C of a counter is cleared to zero. At step S509, a target fuel pressure change permission flag F is reset to "0." Then, the execution of the routine is finished.

If it is judged at step S503 that the vehicle speed Vs is higher than or equal to the prescribed vehicle speed Vk, the routine goes to step S504, where it is judged whether the idling switch signal that was read at step S502 is "on." If the idling switch 16 is not "on," the routine goes to step S508, where the count C of the counter is cleared to "0." At step S509, the target fuel pressure change permission flag F is reset to "0." Then, a return is made to the start. If the idling switch 16 is "on," the routine goes to step S505, where the count C of the counter is incremented. Then, the routine goes to step S506.

At step S506, it is judged whether the count C of the counter has reached a prescribed value Ck. If the count C of the counter has not reached the prescribed value Ck, the routine goes to step S509, where the target fuel pressure change permission flag F is reset to "0." Then, a return is made to the start. If the count C of the counter has reached the prescribed value Ck, the routine goes to step S507, where the target fuel pressure change permission flag F is set to "1." Then, the execution of the routine is finished.

With the above operation, the target fuel pressure change permission flag F is set to "1" if a state that the vehicle speed Vs is higher than or equal to the prescribed vehicle speed Vk and the idling switch 16 is "on" has lasted for a prescribed time (=Ck×(cycle of the routine of FIG. 8)) or more. Otherwise, the target fuel pressure change permission flag F is reset to "0." At steps S107, S206, S307, and S406 of the first to fourth embodiments, a change of the target fuel pressure is permitted if the target fuel pressure change permission flag F has a value "1" and is prohibited if the target fuel pressure change permission flag F has a value "0." Therefore, in this embodiment, a change of the target fuel pressure is prohibited until a state that the vehicle speed is higher than or equal to the prescribed vehicle speed and the throttle valve is entirely closed has lasted for the prescribed time or more. Even if a judgment result "idling state" is produced because of a gear shift during a drive, a change of the target fuel pressure is prohibited. As a result, hunting that relates to the fuel pressure in the accumulator 9 can be prevented.

Embodiment 6

Figure 9:
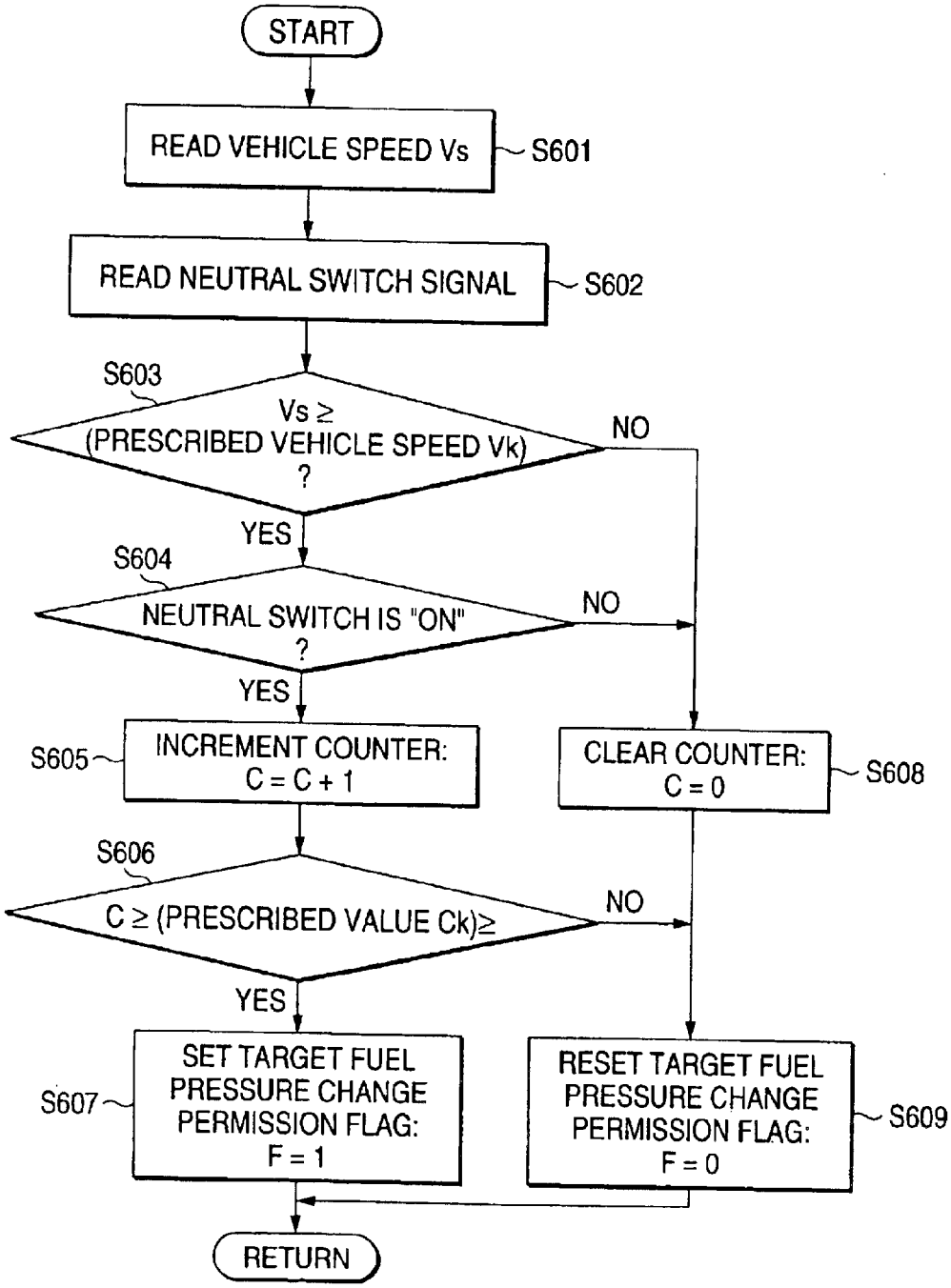
FIG. 9 is a flowchart showing the operation of a fuel pressure control apparatus of an internal combustion engine according to a sixth embodiment of the invention.

FIG. 9 is a flowchart of a control operation of an ECU of a fuel pressure control apparatus of an internal combustion engine according to a sixth embodiment of the invention. This control routine is repeated in a prescribed cycle.

In this embodiment, first, at step S601, a vehicle speed Vs is read from the vehicle speed sensor 19. At step S602, a neutral switch signal is read from the neutral switch 17. At step S603, it is judged whether the vehicle speed Vs that was read at step S601 is higher than or equal to a prescribed vehicle speed Vk. If the vehicle speed Vs is lower than the prescribed vehicle speed Vk, the routine goes to step S608, where the count C of a counter is cleared to zero. At step S609, a target fuel pressure change permission flag F is reset to "0". Then, a return is made to the start. If it is judged at step S603 that the vehicle speed Vs is higher than or equal to the prescribed vehicle speed. Vk, the routine goes to step S604.

At step S604, it is judged whether the neutral switch signal that was read at step S602 is "on." If the neutral switch 17 is not "on," the routine goes to step S608, where the count C of the counter is cleared to 11. At step S609, the target fuel pressure change permission flag F is reset to "0." Then, the execution of this routine is finished. If the neutral switch 17 is "on," the routine goes to step S605, where the count C of the counter is incremented. Then, the routine goes to step S606.

At step S606, it is judged whether the count C of the counter has reached a prescribed value Ck. If the count C of the counter has not reached the prescribed value Ck, the routine goes to step S609, where the target fuel pressure change permission flag F is reset to "0." Then, a return is made to the start. If the count C of the counter has reached the prescribed value Ck, the routine goes to step S607, where the target fuel pressure change permission flag F is set to "1." Then, the execution of the routine is finished.

With the above operation, the target fuel pressure change permission flag F is set to "1" if a state that the vehicle speed Vs is higher than or equal to the prescribed vehicle speed Vk and the neutral switch 17 is "on" has lasted for a prescribed time (=Ck×(cycle of the routine of FIG. 9)) or more. Otherwise, the target fuel pressure change permission flag F is reset to "0." Therefore, a change of the target fuel pressure is prohibited until a state that the vehicle speed is higher than or equal to the prescribed vehicle speed and the transmission is at the neutral position has lasted for the prescribed time or more. Even if a judgment result "the transmission has been shifted to the neutral position" is produced because of a gear shift during a drive, a change of the target fuel pressure is prohibited. As a result, hunting that relates to the fuel pressure in the accumulator 9 can be prevented.

Embodiment 7

Figure 10:
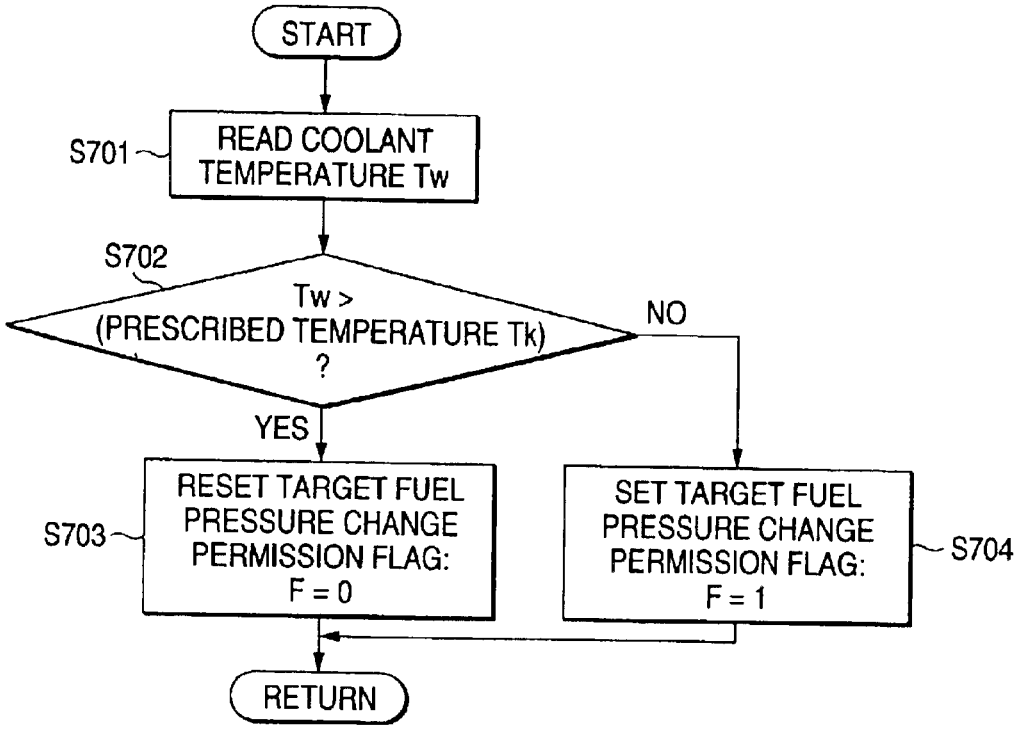
FIG. 10 is a flowchart showing the operation of a fuel pressure control apparatus of an internal combustion engine according to a seventh embodiment of the invention.

FIG. 10 is a flowchart of a control operation of an ECU of a fuel pressure control apparatus of an internal combustion engine according to a seventh embodiment of the invention. In this embodiment, the target fuel pressure is controlled on the basis of the coolant temperature. This control routine is repeated in a prescribed cycle. The operation of the ECU will be described below.

First, at step S701, a coolant temperature Tw is read from the temperature sensor 18. At step S702, it is judged whether the coolant temperature Tw that was read at step S701 is higher than a prescribed temperature Tk. If the coolant temperature Tw is higher than the prescribed temperature Tk, the routine goes to step S703, where a target fuel temperature change permission flag F is reset to "0." Then, the execution of the routine is finished.

If it is judged at step S702 that the coolant temperature Tw is not higher than the prescribed temperature Tk, the routine goes to step S704, where the target fuel temperature change permission flag F is set to "1." Then, the execution of the routine is finished. At steps S107, S206, S307, and S406 of the first to fourth embodiments, a change of the target fuel pressure is permitted or prohibited depending on the resulting value of the target fuel temperature change permission flag F; that is, a change of the target fuel pressure is permitted if the target fuel pressure change permission flag F has a value "1" and is prohibited if the target fuel pressure change permission flag F has a value "0." That is, a change of the target fuel pressure (i.e., to high fuel pressure that is relatively low) by the target fuel pressure switching means is prohibited in a state that the coolant temperature is higher than the prescribed temperature. As a result, generation of fuel vapor in the accumulator can be suppressed.

What is claimed is:

1. A fuel pressure control apparatus of an internal combustion engine, comprising:

a fuel injection valve for injecting fuel into a combustion chamber of the internal combustion engine;

an accumulator for accumulating high-pressure fuel and for supplying fuel to the fuel injection valve;

a fuel pump for supplying the high-pressure fuel to the accumulator;

a fuel pressure sensor for detecting a fuel pressure in the accumulator;

idling detecting means for detecting, on the basis of an accelerator manipulation, whether the internal combustion engine is in an idling state;

control means for controlling an amount of fuel that is supplied from the fuel pump to the accumulator so that the fuel pressure in the accumulator that is detected by the fuel pressure sensor coincides with a target fuel pressure that is set in accordance with a rotation speed and a load of the internal combustion engine; and target fuel pressure switching means for restricting the target fuel pressure to a prescribed fuel pressure or lower while the idling detecting means detects that the internal combustion engine is in an idling state.

2. A fuel pressure control apparatus of an internal combustion engine, comprising:

a fuel injection valve for injecting fuel into a combustion chamber of the internal combustion engine;

an accumulator for accumulating high-pressure fuel and for supplying fuel to the fuel injection valve;

a fuel pump for supplying the high-pressure fuel to the accumulator;

a fuel pressure sensor for detecting a fuel pressure in the accumulator;

idling detecting means for detecting, on the basis of an accelerator manipulation, whether the internal combustion engine is in an idling state;

control means for controlling an amount of fuel that is supplied from the fuel pump to the accumulator so that the fuel pressure in the accumulator that is detected by the fuel pressure sensor coincides with a target fuel pressure that is set in accordance with a rotation speed and a load of the internal combustion engine;

target idling rotation speed setting means for setting a target idling rotation speed for an idling state; and target fuel pressure switching means for switching the target fuel pressure to a target fuel pressure corresponding to the target idling rotation speed and the load of the internal combustion engine while the idling detecting means detects that the internal combustion engine is in an idling state.

3. A fuel pressure control apparatus of an internal combustion engine, comprising:

a fuel injection valve for injecting fuel into a combustion chamber of the internal combustion engine;

an accumulator for accumulating high-pressure fuel and for supplying fuel to the fuel injection valve;

a fuel pump for supplying the high-pressure fuel to the accumulator;

a fuel pressure sensor for detecting a fuel pressure in the accumulator;

control means for controlling an amount of fuel that is supplied from the fuel pump to the accumulator so that the fuel pressure in the accumulator that is detected by the fuel pressure sensor coincides with a target fuel pressure that is set in accordance with a rotation speed and a load of the internal combustion engine;

a transmission shift position detecting means for detecting a shift position of a transmission; and target fuel pressure switching means for restricting the target fuel pressure to a prescribed fuel pressure or lower while the transmission shift position detecting means detects that the transmission is at a neutral position.

4. A fuel pressure control apparatus of an internal combustion engine according to claim 1, wherein the target fuel pressure switching means switch the target fuel pressure to a target fuel pressure corresponding to the target idling rotation speed and the load of the internal combustion.

5. The fuel pressure control apparatus of an internal combustion engine according to claim 1, wherein the prescribed fuel pressure that is set by the target fuel pressure switching means is equal to a target fuel pressure for an idling state of the internal combustion engine.

6. The fuel pressure control apparatus of an internal combustion engine according to claim 1, further comprising a vehicle speed sensor for detecting a running speed of a vehicle, wherein a change of the target fuel pressure by the target fuel pressure switching means is prohibited for a prescribed time while the vehicle speed is higher than or equal to a prescribed speed and the idling detecting means detects an idling state.

7. The fuel pressure control apparatus of an internal combustion engine according to claim 3, further comprising a vehicle speed sensor for detecting a running speed of a vehicle, wherein a change of the target fuel pressure by the target fuel pressure switching means is prohibited for a prescribed time while the vehicle speed is higher than or equal to a prescribed speed and the transmission shift position detecting means detects that the transmission is at the neutral position.

8. The fuel pressure control apparatus of an internal combustion engine according to claim 7, further comprising a temperature sensor for detecting a coolant temperature of the internal combustion engine, wherein a change of the target fuel pressure by the target fuel pressure switching means is prohibited while the coolant temperature detected by the temperature sensor is higher than a prescribed temperature.

* * * * *